US006293234B1

(12) United States Patent
David

(10) Patent No.: US 6,293,234 B1
(45) Date of Patent: Sep. 25, 2001

(54) TWO-STROKE INTERNAL COMBUSTION ENGINE HAVING IMPROVED FUEL PORTING

(75) Inventor: Jeffrey A David, Macedon (AU)

(73) Assignee: Applied Automotive Concepts Pty LTD, Bendigo (AU)

( * ) Notice: Subject to any disclaimer, the term of this patent is extended or adjusted under 35 U.S.C. 154(b) by 0 days.

(21) Appl. No.: 09/423,841

(22) PCT Filed: Apr. 27, 1998

(86) PCT No.: PCT/AU98/00303

§ 371 Date: Mar. 2, 2000

§ 102(e) Date: Mar. 2, 2000

(87) PCT Pub. No.: WO98/51909

PCT Pub. Date: Nov. 19, 1998

(30) Foreign Application Priority Data

May 15, 1997 (AU) ..... PO 6805

(51) Int. Cl.[7] ..... F02B 33/04
(52) U.S. Cl. ..... 123/73 R
(58) Field of Search ..... 123/73 R, 73 PP, 123/73 AF, 73 S, 65 B

(56) References Cited

U.S. PATENT DOCUMENTS 4,261,306 * 4/1981 Gorr ..... 123/73 A
4,660,514 * 4/1987 Nerstrom ..... 123/65 V

* cited by examiner

*Primary Examiner*—Tony M. Argenbright
*Assistant Examiner*—Hyder Ali
(74) *Attorney, Agent, or Firm*—Andrus, Sceales, Starke & Sawall, LLP

(57) ABSTRACT

The port-controlled two-stroke engine includes a combustion chamber, a crankcase containing a combustible mixture, a cylinder, a piston working in the cylinder, an intake duct terminating in an intake port in the cylinder wall for delivering the combustible mixture to the engine, and at least one flywheel rotatively mounted in the crankcase about an axis of rotation. The rotation of the flywheel acts to drive the boundary layer of the combustible mixture immediately adjacent the periphery of the flywheel around the periphery. The engine further includes a transfer passage, extending from a first transfer port in the cylinder wall adjacent the crankcase to a second transfer port in the cylinder wall adjacent the combustion chamber, for conveying the combustible mixture from the crankcase to the combustion chamber, the first transfer port being substantially radially located with respect to the axis of rotation.

14 Claims, 3 Drawing Sheets

TWO-STROKE INTERNAL COMBUSTION ENGINE HAVING IMPROVED FUEL PORTING

BACKGROUND OF THE INVENTION

This invention relates to two-stroke combustion engines and more particularly to port-controlled two-stroke combustion engines wherein the movement of a piston within a cylinder acts to open and close intake, exhaust and transfer ports of that engine.

Port-controlled two-stroke combustion engines generally comprise a cylinder, a piston working in the cylinder, a crankcase and one or more flywheels rotatably mounted in the crankcase. An intake port and an exhaust port are provided in the cylinder wall respectively for admitting and exhausting combustible mixture to the engine. Transfer ports are also provided in the cylinder wall. Transfer passages, which each extend between a respective crankcase transfer port and a respective combustion chamber transfer port, convey air/fuel mixture from the crankcase to the combustion chamber.

In two-stroke engines of this type, the combustible mixture flows through the intake port into the cylinder at the crankcase side of the piston when the piston is adjacent the cylinder head. As the engine fires and the piston moves towards the crankcase, this combustible mixture is then compressed in the crankcase. When the piston approaches its extremity of travel closest to the crankcase, it uncovers transfer ports in the cylinder wall. This allows the combustible mixture which has been compressed in the crankcase to flow along the transfer passages into the cylinder between the piston and the cylinder head.

The power of such two-stroke engines is dependent upon the efficiency of the circulation of the combustible mixture when the engine is in operation and, in particular, the efficient transfer of combustible mixture from inside the crankcase to the combustion chamber. For this reason, conventional two-stroke engines generally attempt to maximize the total cross-sectional of the transfer passages and associated porting by providing at least one transfer passage on each side of the cylinder wall and an auxiliary transfer passage on the same side of the cylinder wall as the intake port.

SUMMARY OF THE INVENTION

Nevertheless, it has been found during the development of the present invention that the delivery of the combustible mixture in the engine, notably through the transfer passages, is inadequate and results in unacceptable engine performance in many circumstances. It is an object of the invention to provide a port-controlled two-stroke engine which exhibits an improved delivery of combustible mixture within the engine during operation with respect to known port-controlled two-stroke engines.

It is a further object of the invention to provide a port-controlled two-stroke engine with improved delivery of combustible mixture during operation from the crankcase to the cylinder head.

It is another object of the invention to provide a port-controlled two-stroke engine which is simple, efficient and powerful.

It is still another object of the invention to provide a port-controlled two-stroke combustion engine which ameliorates or overcomes at least some of the disadvantages of known port-controlled two-stroke combustion engines.

With this in mind, the present invention provides a port-controlled two-stroke engine comprising a combustion chamber, a crankcase containing a combustible mixture, a cylinder having a front and a rear, a piston working in the cylinder, an intake duct terminating in an intake port in the front of the cylinder wall for delivering the combustible mixture to the engine, at least one flywheel rotatively mounted in the crankcase about an axis of rotation, the rotation of the flywheel acting to drive the boundary layer of the combustible mixture immediately adjacent the periphery of the flywheel around the periphery, and a transfer passage, extending from a first transfer port in the rear of the cylinder wall adjacent said crankcase to a second transfer port in the rear of the cylinder wall adjacent the combustion chamber, for conveying the combustible mixture from the crankcase to the combustion chamber, the flywheel having a plane of rotation which passes through one or more of the first transfer port, transfer passage and second transfer port, the intake port and the intake duct being oriented so as to deliver the combustible mixture directly into the crankcase, the intake duct being located in substantially the same plane as a plane of rotation of the flywheel.

According to such an arrangement, the first transfer port in the cylinder wall adjacent the crankcase is located to take advantage of the momentum imparted by the rotating flywheel or flywheels to the boundary layer of combustible mixture around its periphery. Placing this first transfer port, in addition to the transfer passage and second transfer port, in a plane of rotation of the flywheel enables the boundary layer of combustible mixture to be transferred directly into the transfer port and through the transfer passage, rather than the tortuous path provided in prior art two-stroke engines having laterally located transfer passages, and maximizes the efficiency of the transfer of the boundary layer of combustible liquid into the first transfer port and along and out of the transfer passage.

In known two-stroke internal combustion engines, the intake duct is arranged to deliver combustible mixture into the cylinder at a location remote from the crankcase. By direct delivery of the combustible mixture into the crankcase, the force applied to the boundary layer of combustible mixture by the flywheel or flywheels is taken advantage of to optimize the efficiency with which the combustible mixture drawn into the engine through the intake duct is transferred around the periphery of the flywheel or flywheels and into the transfer port in the cylinder wall adjacent the crankcase.

By locating, the intake duct and the transfer duct in substantially the same plane as a plane of rotation of the flywheel or flywheels, combustible mixture is drawn into the engine through the intake valve and it passes around the periphery of the flywheel, into the transfer port adjacent through crankcase and through the transfer passage into the combustion chamber in a relatively unrestricted manner, as this circulation takes place in the one plane without requiring rapid changes in direction of the combustible mixture.

In a preferred embodiment, a flywheel or flywheels have two opposed faces immediately adjacent interior surfaces of the crankcase. According to such an arrangement, the chambers located laterally of the opposing faces of the flywheel or flywheels, required in known two-stroke internal combustion engines in order for the combustible mixture to be provided from the crankcase and into the laterally located transfer passages, may be omitted. This enables the exterior faces of the flywheel or flywheels to be placed in close proximity to, or flush against, the interior wall of the crankcase. A reduction in the volume of combustible mixture is thus achieved, which increases the pressure of the combustible mixture in the crankcase to more efficiently drive this combustible mixture into the front-located transfer port or ports.

According to another aspect of the invention, the second transfer port in the cylinder wall adjacent the combustion chamber has a minimum radius of 1.0 mm between the cylinder wall and the transfer passage. This arrangement enables the efficiency of the two-stroke internal combustion engine to be improved by a reduction in the turbulent flow of the combustible mixture circulated in the engine.

In one embodiment, the first transfer port has a minimum radius of 2.0 mm, and preferably 2.5 mm, between the wall of the cylinder and the transfer passage. Preferably, the first transfer port has a progressively variable minimum radius between the wall of the cylinder and the transfer passage. The radius of the first transfer port may progress, for example, from a minimum of 2.0 mm at the wall of the cylinder to a minimum of 13 mm adjacent to the transfer passage so that the first transfer port has a bell-shaped mouth. This progressive radius change further reduces the turbulence of the combustible mixture flow in the transfer passage. The bell-shaped mouth of the first transfer port is provided to make the maximum effect of the momentum of the gaseous mixture rotating around the crankcase being propelled into the transfer passage 21. In at least one embodiment of the invention, the transfer passage has a cross sectional area which progressively decreases along its length from the first transfer port to the second transfer port. Accordingly, abrupt changes in cross sectional area are avoided along the length of the transfer passage and the efficiency of the delivery of the combustible mixture in the engine is improved.

In another aspect of the invention, one or more vanes are provided on at least one of the faces of the flywheel or flywheels to drive the combustible mixture in the crankcase in the direction of rotation of the flywheel or flywheels. The transfer of force from the rotating flywheel to the combustible mixture in the crankcase once again acts to improve the efficiency of the delivery of the combustible mixture into and through the transfer passage to the combustion chamber much like a paddle wheel in water.

Preferably, the vanes extend radially along at least one face of the flywheel or flywheels.

According to another aspect of the invention, one or more vanes may be provided on a peripheral surface of the flywheel or flywheels to drive the boundary layer around the periphery of the flywheel or flywheels. Again, such vanes contribute to improving the efficiency of the delivery of the circulating combustible mixture in the engine.

BRIEF DESCRIPTION OF THE SEVERAL VIEWS OF THE DRAWING

Preferred arrangements of the present invention are depicted in the accompanying drawings, but those drawings are not to be understood as illustrating the only possible form or arrangement of the various features which go to make up a two-stroke engine according to the invention.

In the drawings

DETAILED DESCRIPTION OF THE INVENTION

Figure 1:
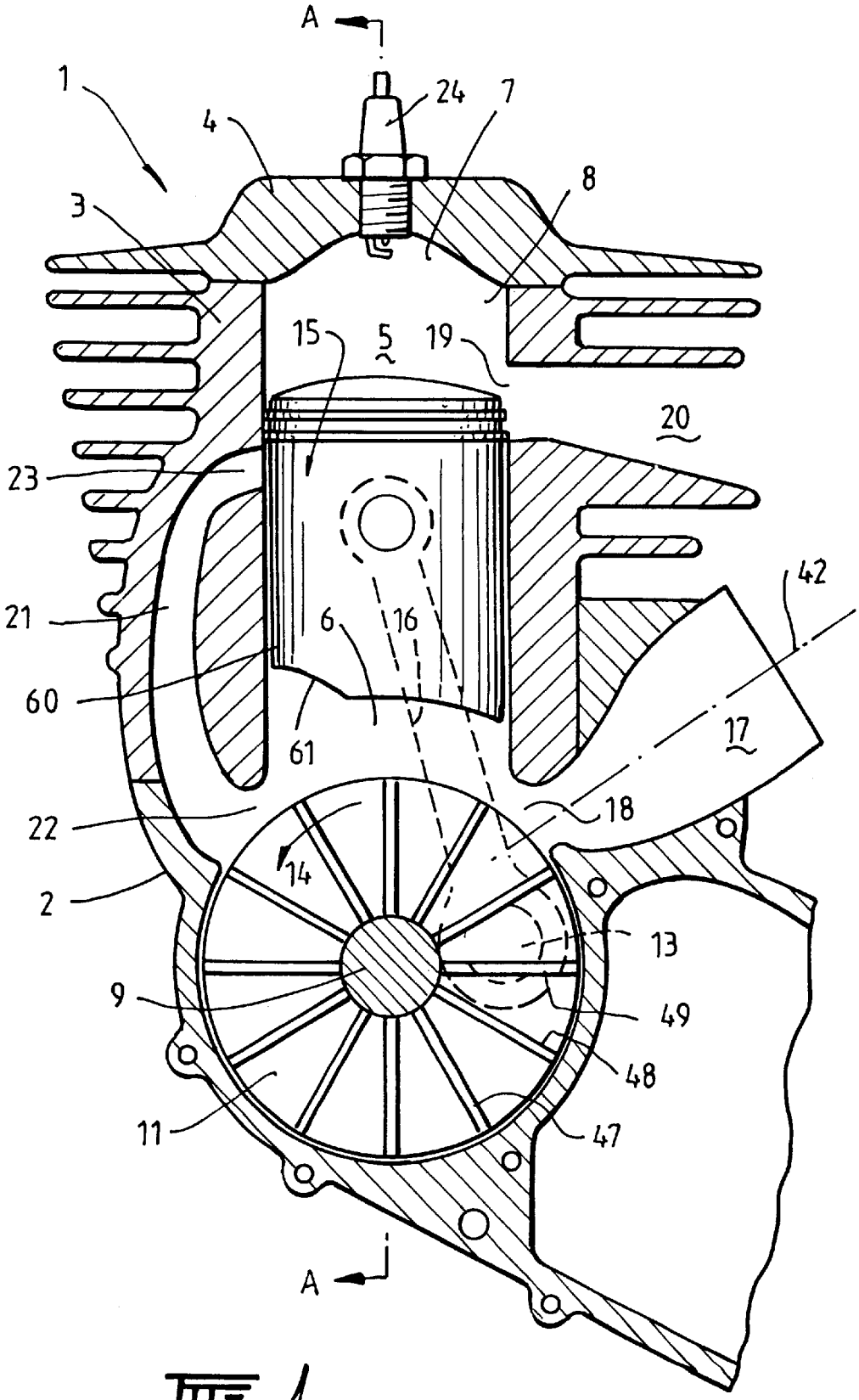
FIG. 1 is a cross-sectional side view of a two-stroke engine according to the present invention.
Figure 2:
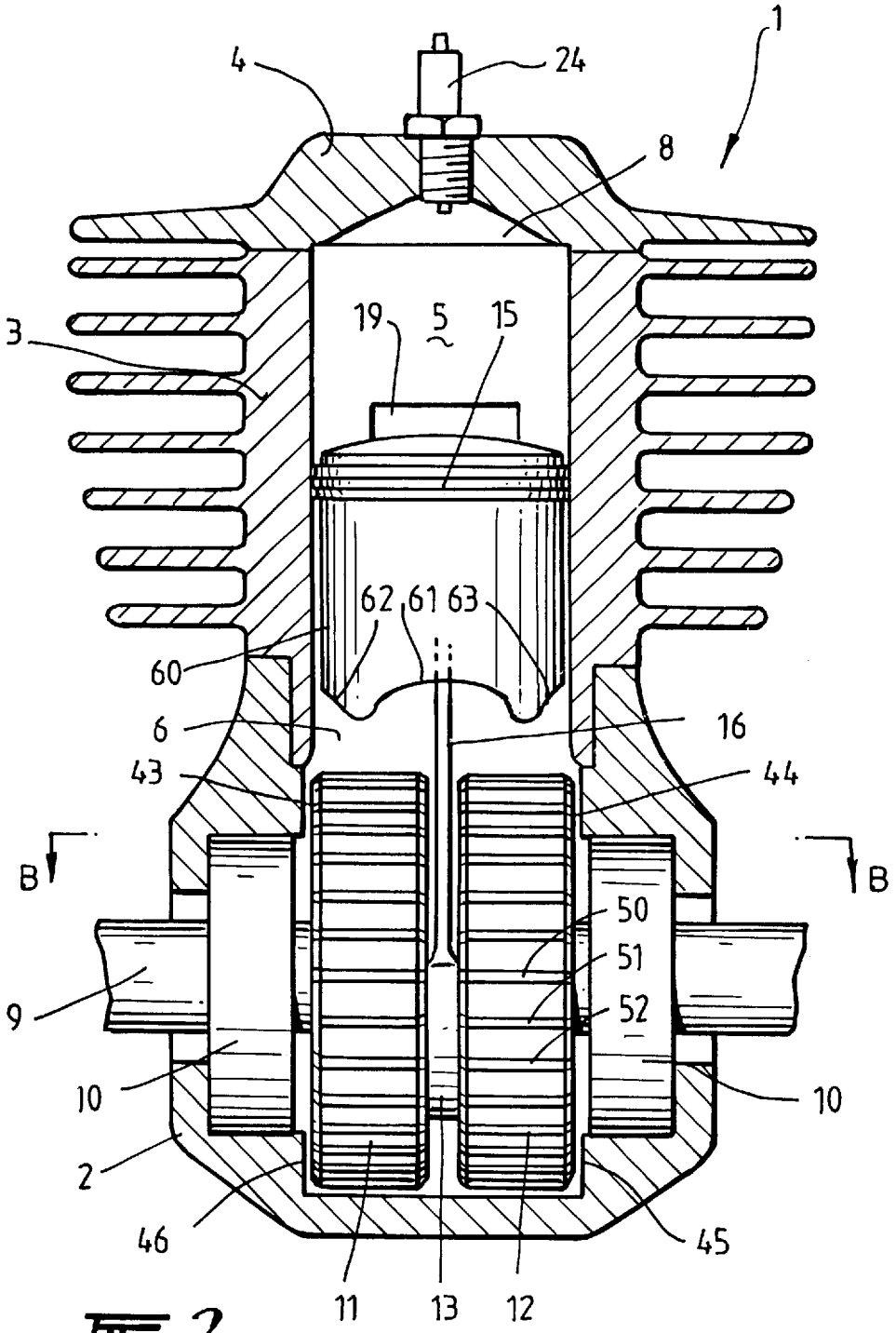
FIG. 2 is a cross-sectional front view of the two-stroke engine shown in FIG. 1 taken through the line A—A.

Referring now to FIGS. 1 and 2, there is shown a two-stroke internal combustion engine 1 comprising a crankcase 2, a cylinder component 3 and a cylinder head 4, which together define the cylinder 5. The end 6 of the cylinder at the crankcase is open while the cylinder head forms a closed end 7 of the cylinder to thus define a combustion chamber 8. A crankshaft 9 is rotatably mounted by means of bearings 10 in the crankcase. The crankshaft 9 includes a pair of flywheels 11 and 12 and a crankpin 13 connecting the flywheels. When the engine is running the crankshaft rotates in the direction indicated by the arrow 14. A piston 15 reciprocates in the cylinder and is connected to the crankshaft by a connecting rod 16.

The combustible mixture for the engine is formed in a carburetor (not shown) and flows into the engine through an intake duct 17 which terminates in an intake port 18 in the cylinder wall. The exhaust gases of the engine flow from an exhaust port 19 in the cylinder wall out through an exhaust duct 20. A transfer passage 21, which extends between a crankcase transfer port 22 at the crankcase end of the cylinder and a combustion chamber transfer port 23 at the combustion chamber end of the cylinder, conveys fluid from inside the crankcase 2 to the combustion chamber 8.

With a combustible mixture in the combustion chamber 8 and with the piston at top-dead-center, a spark between the electrodes of the spark plug 24 will ignite that combustible mixture. The force created by that ignition will drive the piston 15 towards bottom-dead-center, with the crankshaft 9 turning in the direction indicated by the arrow 14. When the moving piston 15 starts uncovering the exhaust port 19 the burned gases are allowed to escape through the exhaust duct 20. The moving piston will also have uncovered the intake port 18 so that the combustible mixture at the crankshaft side of the piston is compressed inside the crankcase 2 and the adjacent end of the cylinder. When the piston 15 moves sufficiently far in the cylinder 5 to uncover the transfer port 23 that compressed mixture flows from inside the crankcase 2 through the transfer port 22, along the transfer passage 21 and into the cylinder 5 through the transfer port 23. As the piston again returns to top-dead-center, its covers the ports 23 and 19 and opens the port 18. The opening of the intake port 18 again permits the combustible mixture to flow from the carburetor into the engine. The above-described cycle is then continuously repeated.

The rotation of the crankshaft 9 inside the crankcase 2 in the direction of the arrow 14 causes a rotation of the combustible mixture inside the crankcase in the same direction. The rotation of the flywheels 11 and 12 acts to impart a flow to the combustible mixture immediately adjacent the periphery of the flywheels in the direction of the arrow 14.

In order to take advantage of the momentum of this rotating combustible mixture, the transfer port 22 located immediately adjacent the crankcase 2 is located substantially radially with respect to the axis of rotation of the flywheels 11 and 12. This way, the transfer duct 22 is effectively placed in the path of the boundary layer rotating around the periphery of the flywheels 11 and 12 and its momentum used to transfer this combustible mixture through the transfer passage 21 into the combustion chamber 5. The efficiency of delivery of the combustible mixture as well as the transfer time is found to be greatly improved with respect to known two-stroke internal combustion engines.

Figure 3:
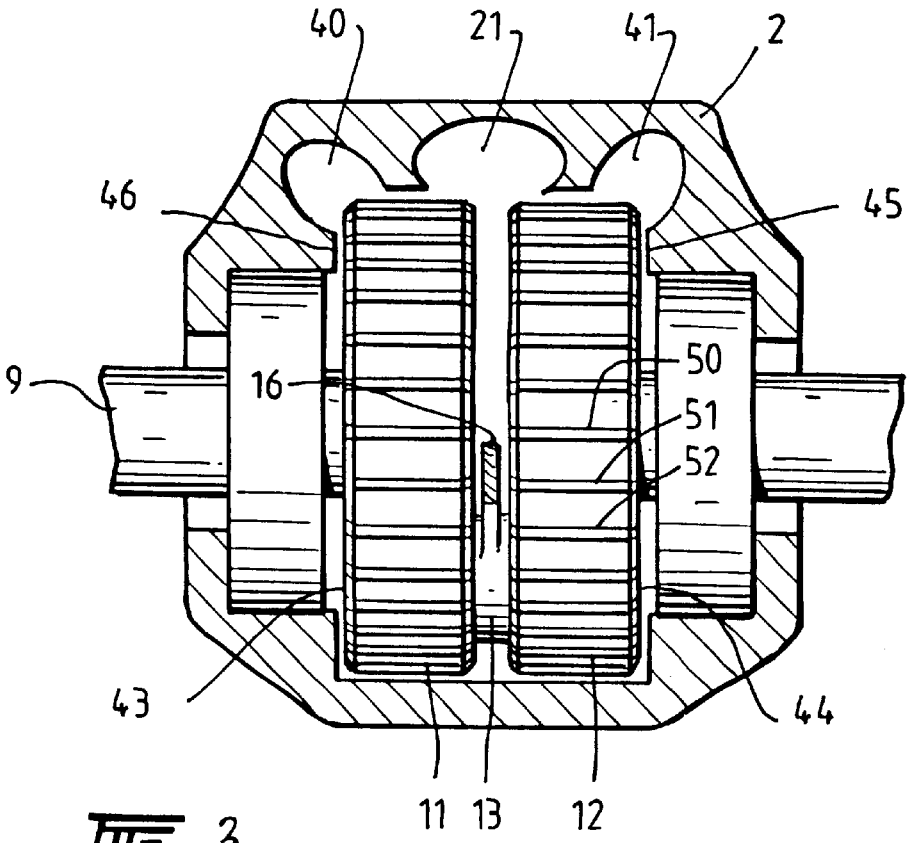
FIG. 3 is a cross-sectional plan view of the two-stroke engine shown in FIG. 2 taken along the line B—B; and, FIG. 4 is side view of the piston forming part of the two-stroke engine shown in FIG. 1.

The relationship of the transfer passage 21 may be better appreciated by referring to FIG. 3, which shows a plan cross sectional view of the two-stroke engine shown in FIG. 2. From this figure, it can be seen that the transfer port 22 is located such that at least one plane of rotation of the flywheels 11 and 12 passes therethrough so as to directly transfer the combustible mixture rotating in the boundary layer around the periphery of the flywheels 11 and 12 directly into the transfer passage 21. Preferably, one or more additional transfer ports 40 and 41 may be provided adjacent to the first transfer port 21 to increase the volume of combustible mixture transferred from the crankcase to the combustion chamber, thus improving the efficiency of the circulation of the combustible mixture in the two-stroke engine 1.

Returning again to FIG. 1, the intake port 18 and associated intake duct 17 are oriented so as to deliver the combustible mixture provided to the engine directly into the crankcase. In order to achieve this, the intake duct 17 may be located such that its longitudinal axis 42 passes through one or more of the flywheels 11 and 12. Combustible mixture delivered through the intake duct in such an arrangement is delivered directly into the boundary layer circulating around the periphery of the flywheels 11 and 12. The delivery of this combustible mixture into the transfer passage 21 is therefore optimized.

Additional measures may also be taken in order to optimism the circulation of the combustible mixture within the engine. For example, the intake duct 17, the transfer duct 21 and a plane of rotation of one or more of the flywheels 11 and 12 may be located in substantially the same plane. Advantageously, the combustible mixture introduced into the engine through the intake duct 17 and transferred across the cylinder 5 into the transfer passage 21 prior to use in the combustion chamber 8 and expulsion through the exhaust duct 20, remains substantially within the same plane and is thus not subjected to rapid changes in direction which would otherwise impair the efficiency of delivery of the combustible mixture. The rapidity of delivery of the combustible mixture as well as the general efficiency of the engine is therefore improved with respect to prior art two-stroke engines.

As a consequence of the forward location of the transfer port 22, chambers located to either side of the exterior faces of the flywheels 11 and 12 -required in prior art two-stroke internal combustion engines in order to deliver combustible mixture in the crankcase 2 into laterally located transfer passages are no longer required. The efficiency of operation of the engine may therefore be improved by locating the interior surfaces of the crankcase immediately adjacent the exterior faces of the flywheels 11 and 12. This is best appreciated from FIGS. 2 and 3, which show an exterior face 43 of the flywheel 11 and an exterior face 44 of the flywheel 12 in close proximity to interior surfaces 45 and 46 of the crankcase 2. In embodiments of the invention where only one flywheel is present, the exterior faces of the flywheel will be constituted by both faces of that flywheel. In this sense, the word "exterior" is meant to refer to those faces of the flywheel or flywheels which are not adjacent a face of another flywheel. Accordingly, the volume of the crankcase may be reduced, which results in a more efficient pumping of the combustible mixture being required by the engine and enables the rotational force of the flywheels 11 and 12 to be more efficiently transferred to that combustible mixture present within the crankcase 2.

In order to reduce turbulence and improve the laminar flow of the combustible mixture circulating within the engine, the transfer port 23 has a minimum radius 64 of 1.0 mm, and preferably 1.25 mm between the wall of the cylinder 5 and the transfer passage 21. Preferably, the same minimum radius is applied to the transfer ports associated with the combustion chamber end of the additional transfer passages 40 and 41.

To the same end, the transfer port 22 has a minimum radius 65 of 2.0 mm, and preferably 2.5 mm, between the wall of the cylinder 5 and the transfer passage 21. The same minimum radius may also be applied to the corresponding transfer ports of the transfer passages 40 and 41. Preferably, the minimum radius 65 between the wall of the cylinder 5 and the transfer passage progressively varies, for example, from a minimum of 2.0 mm at the wall of the cylinder 5 to a minimum of 13.0 mm adjacent the transfer passage 21 such that the transfer port 22 has a bell-shaped mouth.

Moreover, the transfer passages 21, 40 and 41 may each have a cross sectional area which progressively decreases along their respective lengths from their crankcase end to their combustion chamber end. Abrupt changes in cross sectional area and flow rates of the combustible mixture within these transfer passages are therefore avoided. It has been found in practice that a progressive decrease of approximately 20% along the length of the transfer passage is suitable for this purpose.

Another measure of improving the efficient delivery of combustible mixture within the two-stroke internal combustion engine 1 is the provision of one or more vanes 47, 48 and 49 on at least one of the faces of the flywheels 11 and 12. These vanes act to drive the combustible mixture present within the crankcase in the direction 14 of rotation of the flywheels 11 and 12. Preferably, these vanes 47, 48 and 49 extend radially along a face of the flywheels 11 and 12. Although only the exterior face 43 of flywheel 11 is shown as having vanes of this nature, it is to be understood that more than one or all faces of the flywheels mounted in the crankcase may be provided with such vanes.

In addition or as an alternative to the vanes 47, 48 and 49, peripherally mounted vanes such as those referenced 50, 51 and 52 may be provided on a peripheral surface of one or more of the flywheels 11 and 12 in order to drive the boundary layer of combustible mixture around the periphery of the flywheels 11 and 12. Such vanes may be provided on one or more or all of the flywheels mounted within the crankcase 2.

The vanes 47, 48 and 49 shown in FIG. 1, as well as the vanes 50, 51 and 52 shown in FIGS. 2 and 3 may be provided by projections from the flywheels 11 and 12 or by the provision of notches, grooves or other indentations in the flywheels 11 and 12.

Figure 4:
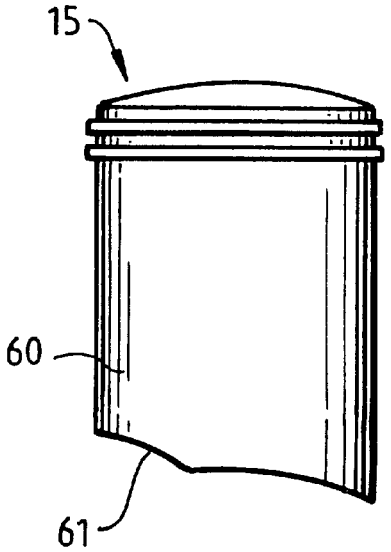

FIGS. 2 and 4 show respectively a front view and a side view of the piston 15. A front skirt 60 facing the transfer port 22 is contoured so as to minimize the restrictive and turbulent flow of the combustible mixture into the transfer passage 21 when the piston 15 is near the bottom of its travel in the cylinder 5. In that regard, the skirt 60 includes a recess 61 having a shape substantially corresponding to that of the transfer port 22 and being coincident therewith when the piston 15 is near bottom-dead-centre. Additionally, the skirt 60 may include additional recesses, such as those referenced 62 and 63, having shapes corresponding to that of transfer ports 40 and 41 and being coincident therewith when the piston 15 is near bottom-dead-centre.

Since modifications within the spirit and scope of the invention may be readily effected by persons skilled in the art, it is to be understood that the invention is not limited to the particular embodiment described, by way of example, hereinabove.

What is claimed is:

1. A port-controlled two-stroke engine comprising a combustion chamber, a crankcase containing a combustible mixture, a cylinder having a cylinder wall, a piston working in the cylinder, an intake duct terminating in an intake port, said intake port delivering the combustible mixture to the engine, at least one flywheel rotatively mounted in the crankcase about an axis of rotation, the rotation of the flywheel acting to drive the boundary layer of the combustible mixture immediately adjacent the periphery of the flywheel around the periphery, and a transfer passage extending from a first transfer port in the cylinder wall adjacent said crankcase to a second transfer port opening in the cylinder wall adjacent the combustion chamber, said first transfer port being spaced from said combustible mixture intake port along the periphery of said flywheel, said first transfer port receiving combustible mixture driven by the flywheel and conveying the combustible mixture from the crankcase to the combustion chamber, the flywheel having a plane of rotation which passes through one or more of the first transfer port, transfer passage and second transfer port.

2. A port-controlled two-stroke engine according to claim 1, wherein said flywheel has two opposed faces immediately adjacent interior surfaces of the crankcase.

3. A port-controlled two-stroke engine according to claim 1, wherein said second transfer port in the cylinder wall adjacent the combustion chamber has a minimum radius of 1.0 mm between the cylinder wall and the transfer passage.

4. A port-controlled two-stroke engine according to any claim 1, wherein said first transfer port has a minimum radius of 2.0 mm.

5. A port-controlled two-stroke engine according to claim 4, wherein said first transfer port has a minimum radius of 2.5 mm between the wall of the cylinder and the transfer passage.

6. A port-controlled two-stroke engine according to claim 1, wherein said first transfer port has a progressively variable minimum radius between the wall of the cylinder and the transfer passage.

7. A port-controlled two-stroke engine according to claim 6, wherein said radius of the first transfer port progresses from a minimum of 2.0 mm at the wall of the cylinder to a minimum of 13 mm adjacent to the transfer passage so that the first transfer port has a bell-shaped mouth.

8. A port-controlled two-stroke engine according to claim 1, wherein said transfer passage has a cross sectional area which progressively decreases along its length from the first transfer port to the second transfer port.

9. A port-controlled two-stroke engine according to claim 1, wherein at least one vane is provided on a face of said at least one flywheel to drive the combustible mixture in the crankcase in the direction of rotation of said at least one flywheel.

10. A port-controlled two-stroke engine according to claim 9, wherein said vanes extend radially along the face of said at least one flywheel or flywheels.

11. A port-controlled two-stroke engine according to claim 1, wherein at least one vane is provided on a peripheral surface of said at least one flywheel to drive the boundary layer around the periphery of said at least one flywheel.

12. A port-controlled two-stroke engine according to claim 1, wherein said intake duct opens into said crankcase for delivering the combustible mixture to said crankcase.

13. A port-controlled two-stroke engine according to claim 12, wherein said intake duct is located in substantially the same plane as a plane of rotation of the flywheel.

14. A port-controlled two-stroke engine according to claim 1, wherein said intake duct is located in substantially the same plane as a plane of rotation of the flywheel.

* * * * *